US012359541B2

(12) United States Patent
Hoelscher et al.

(10) Patent No.: US 12,359,541 B2
(45) Date of Patent: Jul. 15, 2025

(54) INTERSTITIAL SPACING OF PERFORATING SYSTEM

(71) Applicant: Halliburton Energy Services, Inc., Houston, TX (US)

(72) Inventors: Christopher C. Hoelscher, Arlington, TX (US); Richard Ellis Robey, Mansfield, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/958,075

(22) Filed: Sep. 30, 2022

(65) Prior Publication Data

US 2024/0110467 A1 Apr. 4, 2024

(51) Int. Cl.

*E21B 43/117* (2006.01)
*E21B 43/116* (2006.01)
*E21B 43/119* (2006.01)

(52) U.S. Cl.

CPC ..... *E21B 43/117* (2013.01); *E21B 43/116* (2013.01); *E21B 43/119* (2013.01)

(58) Field of Classification Search

CPC ..... E21B 43/117; E21B 43/116; E21B 43/119
See application file for complete search history.

(56) References Cited

U.S. PATENT DOCUMENTS

| | | | | |
|---|---|---|---|---|
| 4,393,946 | A | 7/1983 | Pottier et al. | |
| 2007/0158109 | A1* | 7/2007 | Zazovsky | E21B 43/117 175/4.6 |
| 2012/0318508 | A1 | 12/2012 | Glenn et al. | |
| 2014/0331852 | A1* | 11/2014 | Martinez | E21B 43/117 89/1.15 |
| 2017/0037712 | A1 | 2/2017 | Davidson | |
| 2022/0154559 | A1 | 5/2022 | Sadler et al. | |
| 2022/0178218 | A1 | 6/2022 | Burky et al. | |

FOREIGN PATENT DOCUMENTS

| | | |
|---|---|---|
| EP | 3101221 | 12/2016 |

OTHER PUBLICATIONS

International Search Report and Written Opinion for International Patent Application No. PCT/US2022/048727 dated Jun. 21, 2023.

* cited by examiner

*Primary Examiner* — Yong-Suk (Philip) Ro
(74) *Attorney, Agent, or Firm* — John Wustenberg; C. Tumey Law Group PLLC

(57) ABSTRACT

A perforating gun system may include a central support structure and a plurality of charges secured to the central support structure. Each charge of the plurality of charges is configured to perforate a casing and/or sidewall of a wellbore upon detonation. Further, the plurality of charges comprises a first group of charges and a second group of charges, and each charge of the second group of charges is radially offset from each charge of the first group of charges with respect to the central support structure.

12 Claims, 8 Drawing Sheets

INTERSTITIAL SPACING OF PERFORATING SYSTEM

BACKGROUND

After drilling a wellbore in a subterranean formation for recovering hydrocarbons such as oil and gas lying beneath the surface, a casing string may be fed into the wellbore. Generally, the casing string protects the wellbore from failure (e.g., collapse, erosion) and provides a fluid path for hydrocarbons during production. To access the hydrocarbons for production, a perforating gun system may be deployed into the casing string via a tool string. The tool string (e.g., a tubing string, wireline, slick line, coil tubing) lowers the perforating gun system into the casing string to a desired position within the wellbore. Once the perforating gun system is in position such that shaped charges are disposed adjacent to a subterranean formation having hydrocarbons, the shaped charges are detonated. The detonation perforates the casing string, the cementing, and the subterranean formation such that hydrocarbons may flow into the casing string via the perforation.

Moreover, once production operations have concluded, plug and abandonment operations may be conducted. Various methods may be used to abandon a wellbore. For example, a perforate-wash-cement method may be used. Such method includes perforating the casing, via a perforating gun system, to obtain access to the annulus between the casing and the wellbore wall, washing the annulus with fluids to help remove cement and debris, and pumping fresh cement into the annulus.

As set forth above, perforating gun systems may be used in various essential wellbore operations (e.g., washing, production, gravel packing, and fracking). The effectiveness of the perforating gun system may determine the performance of these wellbore operations. For example, the flow rate of hydrocarbons during production may be dependent on the effectiveness of the perforations made by the perforating gun system. Traditionally, the effectiveness of the perforations may be based at least in part on a shot density of the perforating gun system. Shot density is based on the size of charges and number of charges of that size positioned a given space on the corresponding perforating gun system Unfortunately, the shot density of a traditional perforating gun systems may be limited by contact between adjacent charges preventing further charges from being placed in the given space of the perforating gun system. Thus, an improved perforating gun system is needed to increase effectiveness of perforations made by perforating gun systems such that the performance of various essential wellbore operations may be improved.

BRIEF DESCRIPTION OF THE DRAWINGS

These drawings illustrate certain aspects of some of the embodiments of the present disclosure and should not be used to limit or define the method.

DETAILED DESCRIPTION

Provided are systems for perforating a subterranean formation and, more particularly, example embodiments may include a perforating gun system configured to increase shot density in a given space on a perforating gun system, such that the perforating gun system may increase the flow area of a perforated well to improve washing, production, gravel packing, and fracking operations. As set forth in detail below, the perforating gun system may include multiple groups of radially offset shaped charges, which may increase the shot density. Indeed, having radially offset shaped charges may allow the shaped charges to be positioned closer together and even slightly overlapped such that the shot density may be increased. The perforating gun system may include additional features such as variably sized charges, as well as angled shaped charges to further increase the shot density and/or effectiveness of the perforations made by the shaped charges. Moreover, the perforating gun system may include various features configured to at least partially counter shock interference and other negative effects resulting from these shot-density improving features.

Figure 1:
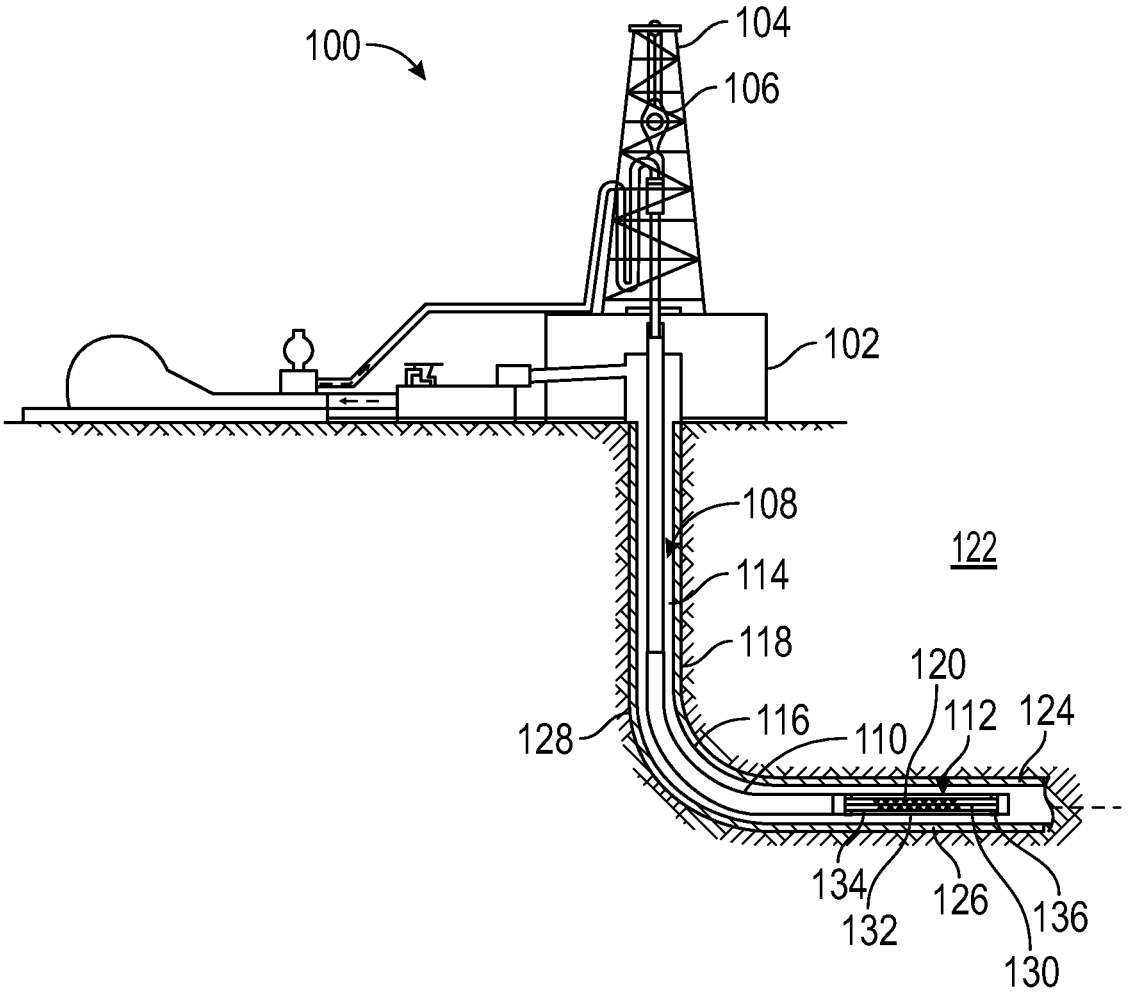
FIG. 1 illustrates a side elevation, partial cross-sectional view of an operational environment for a drilling system, in accordance with one or more embodiments of the disclosure.

FIG. 1 illustrates a side elevation, partial cross-sectional view of an operational environment for a drilling and completion system in accordance with one or more embodiments of the disclosure. It should be noted that while FIG. 1 generally depicts a land-based drilling and completion assembly, those skilled in the art will readily recognize that the principles described herein are equally applicable to subsea drilling and completion operations that employ floating or sea-based platforms and rigs, without departing from the scope of the disclosure. As illustrated, the drilling and completion assembly 100 includes a platform 102 that supports a derrick 104 having a traveling block 106 for raising and lowering a tool string 108. The tool string 108 includes, but is not limited to, a work string 110, a perforating gun system 112, and any other suitable tools, as generally known to those skilled in the art. While not shown, tubing string, wireline, slick line, and/or coil tubing may be used instead of convention work string 110 for supporting the perforating gun system 112.

The work string 110 is configured to lower the perforating gun system 112 into a wellbore 114. As illustrated, the wellbore 114 may be lined with casing. The casing 116 is configured to protect the wellbore 114 from failure (e.g., collapse, erosion) and to provide a fluid path for hydrocarbons during production. To access the hydrocarbons, the work string 110 lowers the perforating gun system 112 to a position such that shaped charges 120 are disposed adjacent to a subterranean formation 122 having the hydrocarbons, and the perforating gun system 112 detonates the shaped charges 120. In some embodiments, the shaped charges 120 may be sequentially detonated by the perforating gun system 112 in a downhole to uphole direction or an uphole to downhole direction. The detonations perforate the casing 116, the cementing, and the subterranean formation 122 in the respective paths of the shaped charge detonations such that hydrocarbons may flow into the casing 116 string via the perforations.

Further, once production operations have concluded, plug and abandonment operations may be conducted to abandon the well. The plug and abandonment operations may include perforating the casing 116, with the perforating gun system 112, to obtain access to an annulus 124 between the casing 116 and the wellbore wall 118. In particular, the casing 116 may be perforated at a downhole and uphole location. With the casing 116 perforated, fluid is pumped into the annulus 124 through the downhole perforations 126 and out of the annulus 124 through the uphole perforations 128 such that the fluid may wash the annulus 124 (e.g., remove mud and debris from the annulus). Once the annulus 124 is washed, cement may be pumped into the annulus 124 through the downhole and/or uphole perforations 128.

The flow rates of various fluids (e.g., hydrocarbons, washing fluid, cement, etc.), associated with various wellbore operations (e.g., production, washing, plugging, etc.), through the casing 116 may be based on the effectiveness of the perforating gun system 112 in perforating the casing 116. Indeed, the flow rates of the various fluids may be proportional to the total flow area through the casing 116 formed by the perforations. Moreover, the total flow area formed by the perforating gun system 112 may be based at least in part on the shot density of the perforating gun system 112. As set forth in detail below, the perforating gun system 112 may include various features to increase the shot density such that the perforating gun system 112 may increase the flow rates and performance of the various wellbore operations.

Generally, the perforating gun system 112 includes a central support structure 130 and the plurality of charges 120 (e.g., shaped charges) secured to the central support structure 130. The central support structure 130 may be supported directly by the work string 110. However, in the illustrated embodiment, the perforating gun system 112 includes a gun body 132 (e.g., gun carrier). The gun body 132 is configured to house a charge tube 134. The charge tube 134 generally has cylindrical shape. However, the charge tube 134 may have any suitable shape. Further, the perforating gun system 112 may include a plurality of mounting devices 136 configured to mount the charge tube 134 within the gun body 132. The mounting devices 136 may radially secure the charge tube 134 within the gun body 132 to prevent an exterior surface of the charge tube 134 from contacting an interior surface of the gun body 132. The central support structure 130 and the shaped charges 120 may be disposed within the charge tube 134.

Figure 2:
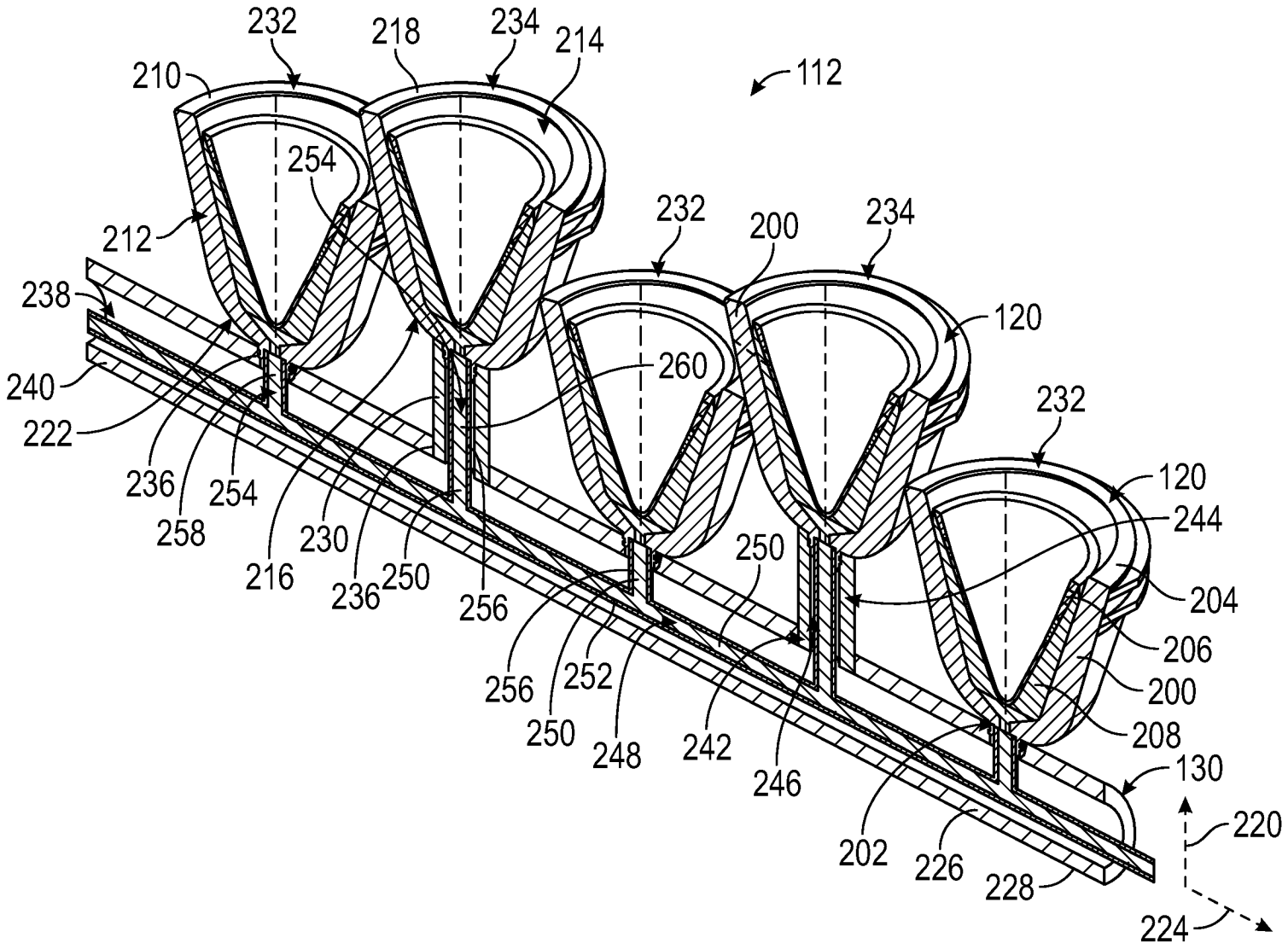
FIG. 2 illustrates a perspective view of a downhole perforating gun system with radially offset shaped charges, in accordance with some embodiments of the present disclosure.

FIG. 2 illustrates a perspective view of a downhole perforating gun system with radially offset shaped charges, in accordance with some embodiments of the present disclosure. As set forth above, the perforating gun system 112 may include the central support structure 130 configured to support the plurality of charges 120 configured to perforate a casing 116 and/or wellbore wall 118 (shown in FIG. 1) upon detonation. Generally, each charge of the plurality of charges 120 includes a charge casing 200 having a coupling end 202 and a distal end 204 disposed radially outward from the coupling end 202 with respect to the central support structure 130. Further, each of the charges 120 include a conical liner 206 disposed at least partially within the charge casing 200, as well as explosive material 208 disposed between the conical liner 206 and the charge casing 200. Upon detonation, the explosive material 208 is configured to expel the conical liner 206 outward from the charge casing 200 to perforate a target material (e.g., the casing 116, the wellbore wall 118, etc.)

The perforations from each charge of the plurality of charges 120 contribute to the total flow area formed through the casing 116. Thus, increasing the shot density of the perforating gun system 112 may increase the total flow area formed through the casing 116, which may increase performance of various wellbore operations. Although shot density is traditionally limited by the number and size of charges in a given space on the perforating gun system 112, as illustrated in the present embodiment, the plurality of charges 120 may be mounted to the central support structure 130 in a radially staggered manner to increase the shot density of the perforating gun system 112. That is, radially staggering the plurality of charges 120 may allow some charges 120 to overlap with each other such that larger charges 120 and/or more charges 120 may fit in the given space, which increases the shot density of the perforating gun system 112. Specifically, the distal end 204 of each charge 120 has a greater diameter than the coupling end 202 of the charge 120 such that the diameter of the charges 120 generally decreases in the radially inward direction with respect to the central support structure 130. Accordingly, a first distal end 210 of a first charge 212 may be radially aligned with a portion of an adjacent second charge 214 between a second coupling end 216 and a second distal end 218 of the second charge 214 (i.e., having a smaller diameter) such that the first charge 212 and the adjacent second charge 214 may be positioned closer together in the axial and/or circumferential directions. That is, at least a portion of the first charge 212 may overlap with the adjacent second charge 214 in a radial direction 220 to reduce spacing between the adjacent charges (e.g., first charge 212 and second charge 214). In particular, at least portions of the respective distal ends 210, 218 of the adjacent charges 212, 214 may overlap in the radial direction 220.

In some embodiments, the first distal end 210 of the first charge and the second distal end 218 of the second charge 214 may be axially offset by five percent to seventy percent of the height of the second charge 214 (e.g., distance between the second coupling end 216 and the second distal end 218). For example, in the illustrated embodiment, the first distal end 210 of the first charge 212 and the second distal end 218 of the second charge 214 are axially offset by about fifty percent of the height of the second charge 214. Additionally, in some embodiments, the first distal end 210 of the first charge 212 and the second distal end 218 of the second charge 214 may be axially offset by five percent to twenty percent of the height of the second charge 214. Moreover, in some embodiments, respective coupling ends 222, 216 of the first charge 212 and the second charge 214 may be offset. For example, the first coupling end 222 of the first charge 212 and the second coupling end 216 of the second charge 214 may be axially offset by five percent to seventy percent of the height of the second charge 214 (e.g., distance between the second coupling end 216 and the second distal end 218).

Further, at least a portion of the first charge 212 may overlap with the adjacent second charge 214 in an axial direction 224. For example, the first distal end 210 of the first charge 212 is axially overlapped with the adjacent second charge 214 between the second distal end 218 and the second coupling end 216 of the second charge 214. That is, in some embodiments, there may not a complete radial offset between adjacent charges 212, 214. Radially staggering the charges 212, 214 may introduce issues such as shock interference into the perforating gun system 112. The shock interference and/or other issues from having completely radially offset charges may reduce the effectiveness of the perforating gun system 112. However, the perforating gun system 112 may include detonation train features configured to at least partially counter shock interference and/or other issues associated with radially staggering the charges 120.

Moreover, as illustrated, the central support structure 130 may comprise a hollow cylindrical shaped body (e.g., hollow tubing 226) having a central bore 238 defined by an inner surface 240 of the hollow tubing 226. However, the central support structure 130 may include any suitable shape. The plurality of charges 120 may be secured to a radially outer surface 228 of the central support structure 130. As illustrated, the charges 120 may be coupled directly to the central support structure 130. That is, the coupling end 202 of each charge of the plurality of charges 120 may be secured to a radially outer surface 228 of the central support structure 130. Additionally, some charges 120 may be indirectly coupled to the central support structure 130 via corresponding extension features 230. The extension features 230 may be used to radially stagger the charges 120.

In the illustrated embodiment, the plurality of charges 120 includes a first group of charges 232 and a second group of charges 234 that are radially offset from the first group of charges 232 with respect to the central support structure 130. The first group of shaped charges 120 are coupled directly to the central support structure 130. Each charge of the first group of charges 232 may be coupled directly to the central support structure 130 by threading into a corresponding threaded bore 236 in the central support structure 130. The central support structure 130 includes a plurality of threaded bores 236 extending through the hollow tubing 226. As set forth above, at least some of the threaded bores 236 are configured to receive charges 236 directly. The remaining threaded bores 236 in the central support structure 130 may be configured to receive corresponding extension features 230.

Each extension feature 230 is configured to couple a corresponding charge 120 of the second group of shaped charges 120 to the central support structure 130 such that each charge 120 of the second group of charges 234 is positioned radially outward from each charge 120 of the first group of charges 232 with respect to the central support structure 130. In the illustrated embodiment, the extension features 230 have tubular shapes. However, the extension features 230 may include any suitable shape. As illustrated, a proximal extension end 242 of each extension feature 230 may be threaded into the corresponding threaded bore 236 of the central support structure 130, and a distal extension end 244 of each extension feature 230 may be coupled to a corresponding charge 120 of the second group of charges 234. However, adhesives and/or other fasteners may additionally or alternatively be used to secure the extension features 230 to the central support structure 130 and to the corresponding charges 120. Moreover, each extension feature 230 may include a central extension bore 246 extending from the distal extension end 244 to a proximal extension end 242 of the extension feature 230 such that a detonation cord 248 may connected from the central support structure 130 to each corresponding charge 120 via the respective central extension bores 246 of the corresponding extension features 230.

As set forth above, the perforating gun system 112 may include detonation train features configured to reduce shock interference and/or other issues associated with radially staggered or offset charges. Regarding shock interference, if adjacent charges 120 fail to detonate at relatively the same time, shockwaves from adjacent charge detonations may interfere with a subsequent detonation of one of the adjacent shock charges. Radially staggering the charges 120 may affect the detonation timings of the charges 120 as a longer distance to a radially offset charge 120 may have a delayed detonation relative to a charge 120 directly connected to the central support structure 130. As set forth in detail below, the detonation train may be configured adjust the detonation timing of the charges 120 to reduce shock interference.

In the illustrated embodiment, the perforating gun system 112 has the detonation cord 248 disposed in the central bore 238 of the central support structure 130. The detonation cord 248 may comprise an explosive powder 250 disposed in an outer sleeve 252. As the first group of charges 232 are directly coupled to the central support structure 130, the detonation cord 248 may be connected directly to the respective coupling ends 202 of each charge 120 of the first group of charges 232. Moreover, the detonation cord 248 may include a plurality of detonation branches 254 configured to couple the detonation cord 248 to the charges 120. The plurality of detonation branches 254 may also comprise explosive powder 250 disposed in an outer branch sleeve 256. The plurality of detonation branches 254 may be manufactured as part of the detonation cord 248. Alternatively, the plurality of detonation branches 254 may be subsequently coupled to the detonation cord 248 via a booster connector, other suitable connectors, or via other suitable methods. In the illustrated embodiment, perforating gun system 112 has a first set of detonation branches 258 configured to couple each charge 120 of the first group of charges 232 to the detonation cord 248. Further, the perforating gun system 112 has a second set of detonation branches 260 configured to couple each charge 120 of the second group of charges 234 to the detonation cord 248. As set forth above, each charge 120 of the second group of charges 234 is coupled to the central support structure 130 via a corresponding extension feature 230. Corresponding detonation branches 254 of the second set of detonation branches 260 may extend through the corresponding extension features 230 to connect each charge 120 of the second group of charges 234 to the detonation cord 248.

The detonation branches 254 of the second set of detonation branches 260 may be longer than the detonation branches 254 of the first set of detonation branches 258 since the second set of detonation branches 260 must extend through the respective extension features 230. Accordingly, the second group of charges 234 would generally have delayed detonation timings with respect to the first group of charges 232 as the second set of detonation branches 260 would burn slower (e.g., due to the difference in length) than the first set of detonation charges 120. However, to adjust the burn timing, the detonation branches 254 of the second set of detonation branches 260 may comprise an explosive powder density greater than an explosive powder density of the first set of detonation branches 258. As the increased density may cause the second set of detonation branches 260 to burn quicker, the first group of charges 232 and the second group of charges 234 may detonate at relatively the same time to reduce shock interference.

Figure 3:
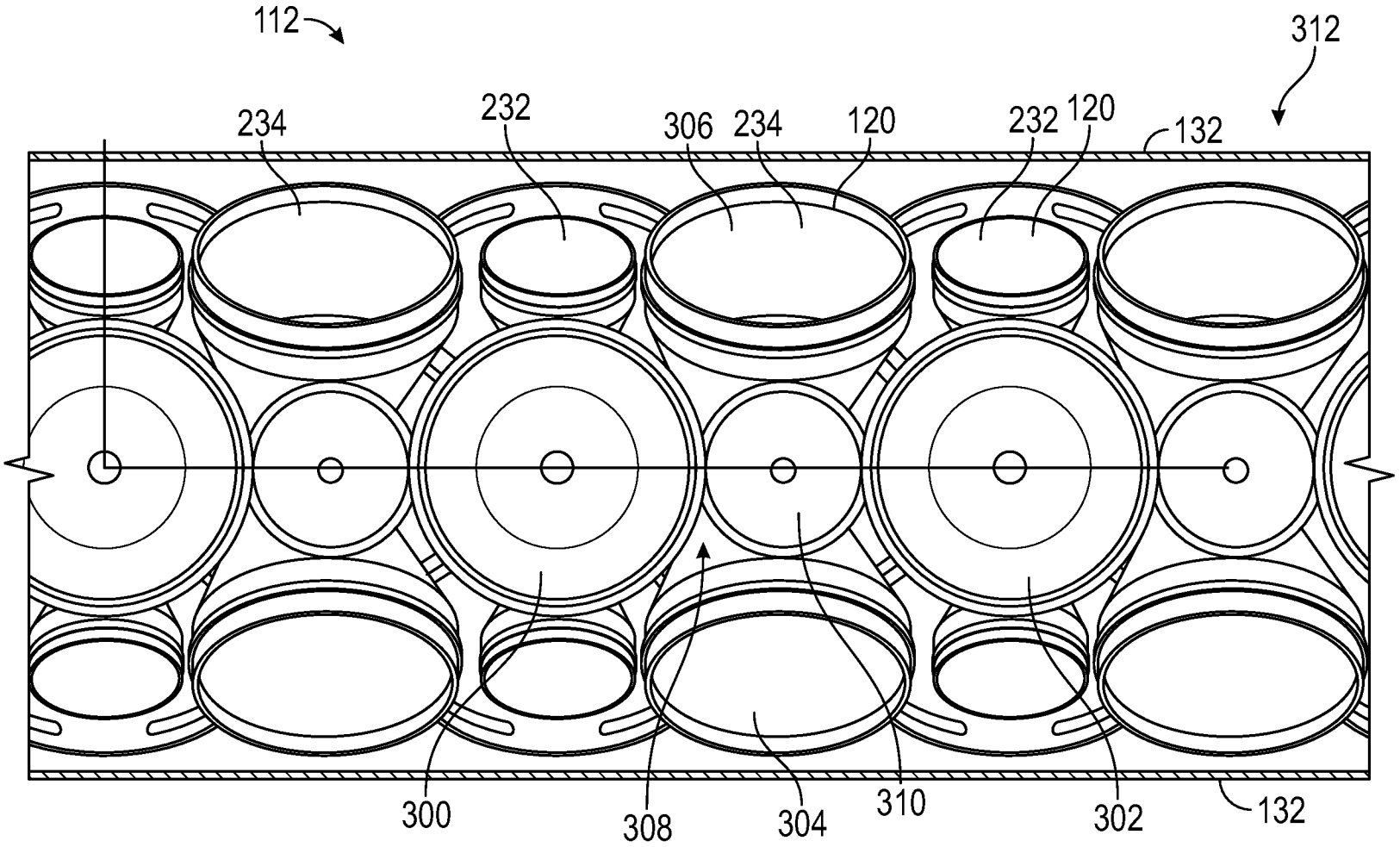
FIG. 3 illustrates a perspective view of a downhole perforating gun system with variably sized shaped charges, in accordance with some embodiments of the present disclosure.

FIG. 3 illustrates a perspective view of a downhole perforating gun system 112 with variably sized shaped charges, in accordance with some embodiments of the present disclosure. As set forth above, the charges 120 may be radially staggered such that the charges 120 may overlap with each other. Overlapping the charges 120 may allow larger charges 120 and/or more charges 120 may fit in the given space, which increases the shot density of the perforating gun system 112. Increasing the shot density may increase the total flow area formed through the casing 116 (shown in FIG. 1), which may increase performance of various wellbore operations. In the illustrated embodiment, each charge 120 of the second group of charges 234 may be positioned radially outward from each charge 120 of the first group of charges 232 with respect to the central support structure 130 (shown in FIG. 2) to radially stagger the charges 120 and increase the shot density of the perforating gun system 112.

The perforating gun system may include variably sized charges 120 to further increase the shot density of the perforating gun system 112. In the illustrated embodiment, each charge 120 of the second group of charges 234 is larger than each charge 120 of the first group of charges 232. For example, the second group of charges 234 may include a first outer charge 300, a second outer charge 302, a third outer charge 304, and a fourth outer charge 306. As shown, the first outer charge 300 and the second outer charge 302 may be axially offset along the central support structure 130, but circumferentially aligned. Further, the third outer charge 304 and the fourth outer charge 306 may be circumferentially offset, but axially aligned. The third outer charge 304 may be positioned axially between the first outer charge 300 and the second outer charge 302 but may be circumferentially offset from the first outer charge 300 and the second outer charge 302 in a clockwise direction. Moreover, the fourth outer charge 306 may be positioned axially between the first outer charge 300 and the second outer charge 302 but may be circumferentially offset from the first outer charge 300 and the second outer charge 302 in the counterclockwise direction.

As illustrated, the positioning of the first outer charge 300, the second outer charge 302, the third outer charge 304, and the fourth outer charge 306, may form a pocket 308 between them that may be too small to fit a similarly sized fifth outer charge. Instead, the perforating gun system 112 may include the first group of charges 232 having each charge 120 sized smaller than the charges 120 of the second group of charges 234. As illustrated, a smaller first inner charge 310 of the first group of charges 232 may fit in the pocket between the adjacent charges (e.g., the first outer charge 300, the second outer charge 302, the third outer charge 304, and the fourth outer charge 306) of the second group of charges 234. Accordingly, having variably sized charges may increase the shot density of the perforating gun system 112 by allowing more charges 120 to fit in the given space on the perforating gun system 112.

Moreover, in some perforating guns 112, a series of charges 120 may traditionally be positioned inside a carrier 312. The charges 120 are traditionally arranged in an alternating plane such that, as the charge case (e.g., gun body 132) expands from detonation of the charges 120, colliding material or fragments can develop as a secondary jet that projects outward, which may damage an area of the gun carrier 312. This phenomenon, which is commonly referred to as charge-to-charge jetting, is generally detrimental to the structural integrity of the carrier 312. However, in the illustrated embodiment, the orientation, spacing (e.g., interstitial spacing), and/or sizing of the charges 120 disrupts the charge-to-charge jetting. Specifically, the first group of charges 232 (e.g., the inner charges) are arranged in between the second group of charges 234 (e.g., the outer charges) to cancel the explosive focus of the charge case and stop the expanding case material to form a jet. The first group of charges 232 (e.g., the smaller charges) jet to provide additional open area in the gun body 132 which provides for faster evacuation of internal explosive pressure, which reduces the time interval of applied Hoop Stress to the gun body 132. Accordingly, the orientation, spacing, and/or sizing of the charges 120 are configured to disrupt the charge-to-charge jetting.

Figure 4:
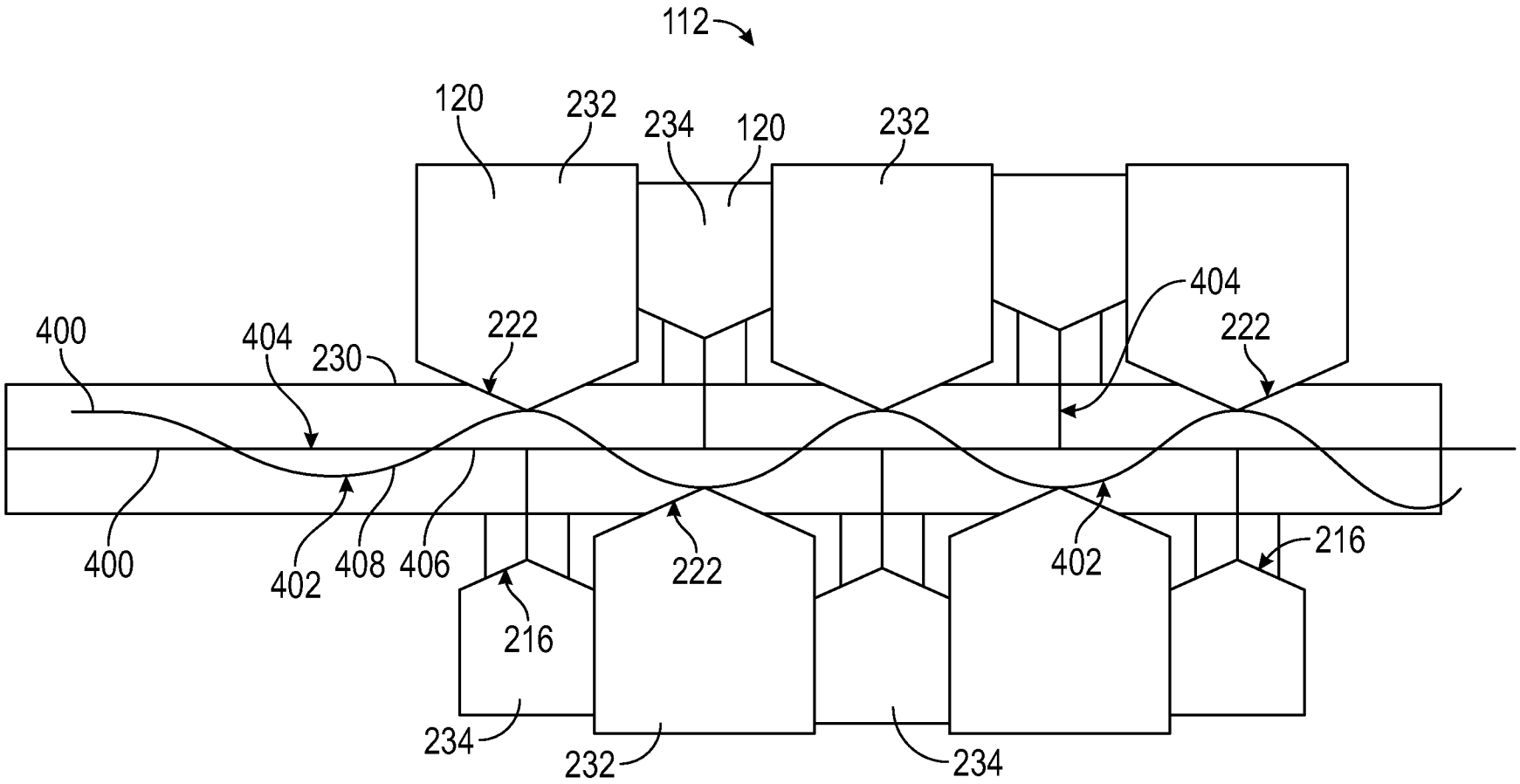
FIG. 4 illustrates a cross-sectional view of a perforating gun system having multiple detonation cords, in accordance with some embodiments of the present disclosure.

FIG. 4 illustrates a cross-sectional view of a perforating gun system 112 having multiple detonation cords 400, in accordance with some embodiments of the present disclosure. The perforating gun system 112 may comprise multiple detonation cords 400 to reduce shock interference. As illustrated, the perforating gun system 112 includes the first group of charges 232 and the second group of charges 234 secured to the central support structure 130. The respective second coupling ends 216 of each charge 120 of the second group of charges 234 may be radially offset from the respective first coupling ends 222 of each charge 120 of the first group of charges 232. Specifically, the respective second coupling ends 216 of each charge of the second group of charges 234 may be disposed radially outward from the respective first coupling ends 222 of each charge of the first group of charges 232 with respect to the central support structure 130. With a traditional detonation train, the second group of charges 234 may have delayed detonations relative the adjacent first group of charges 232 due to the second coupling ends 216 of the second group of charges 234 being farther away from the central support structure 130 than the first coupling ends 222. However, the multiple detonation cords 400 may be configured such that the first group of charges 232 and the second group of charges 234 may detonate at relatively the same time to avoid shock interference.

The perforating gun system 112 may include a first detonation cord 402 connected to each charge 120 of the first group of charges 232 and a second detonation cord 404 connected to each charge 120 of the second group of charges 234. In the illustrated embodiment, the first detonation cord 402 is connected to the first group of charges 232 in series and the second detonation cord 404 is connected to the second group of charges 234 in parallel. However, in some embodiments, first detonation cord 402 may be connected to the first group of charges 232 in parallel and the second detonation cord 404 may be connected to the second group of charges 234 in series.

Moreover, the distance along the first detonation cord 402 between adjacent charges of the first group of charges 232 may be less than the distance along the second detonation cord 404 between adjacent charges of the second group of charges 234 due to the radially offset positions of the charges of the second group of charges 234. To adjust for the difference in lengths between adjacent charges, a density of a second explosive powder 406 of the second detonation cord 404 may be greater than a density of a first explosive powder 408 of the first detonation cord 402. As set forth above, higher density explosive powder may burn faster than lower density explosive powder 250. As such, the second explosive powder 406 may have increased density such that the second detonation cord 404 burns faster than the first detonation cord 402. Thus, the first group of charges 232 and the second group of charges 234 may detonate at relatively the same time since the increased density of the second explosive powder 250 may compensate for the longer distance along the second detonation cord 404 between adjacent charges 120.

Figure 5:
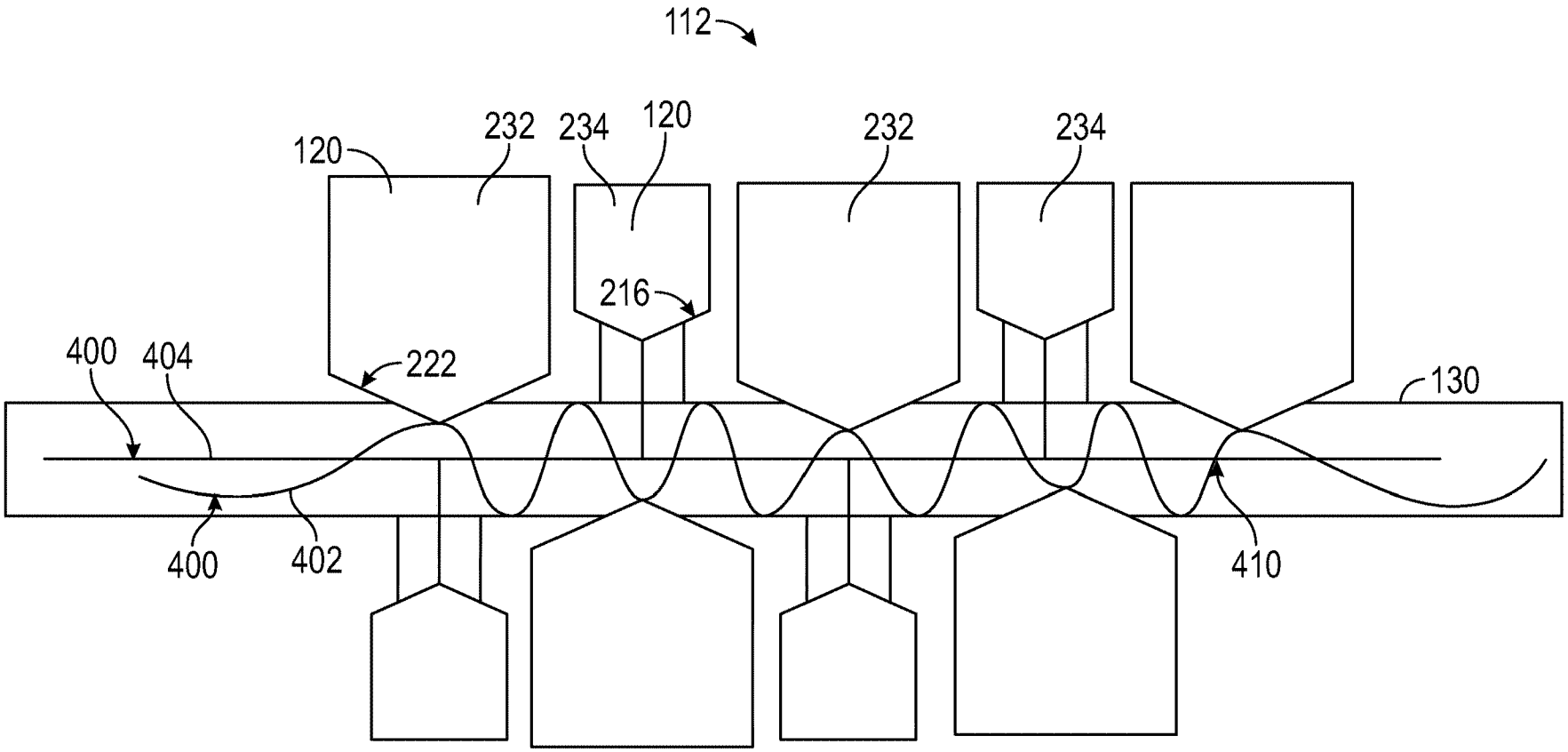
FIG. 5 illustrates a cross-sectional view of the perforating gun system having at least one detonation cord with a lengthening feature, in accordance with some embodiments of the present disclosure.

FIG. 5 illustrates a cross-sectional view of the perforating gun system having at least one detonation cord with a lengthening feature, in accordance with some embodiments of the present disclosure. As set forth above, the perforating gun system 112 may comprise multiple detonation cords 400 to reduce shock interference. Similar to FIG. 4, the perforating gun system 112 may include the first group of charges 232 and the second group of charges 234 secured to the central support structure 130. The respective second coupling ends 216 of each charge 120 of the second group of charges 234 may be radially offset from the respective first coupling ends 222 of each charge 120 of the first group of charges 232. Specifically, the respective second coupling ends 216 of each charge 120 of the second group of charges 234 may be disposed radially outward from the respective first coupling ends 222 of each charge 120 of the first group of charges 232 with respect to the central support structure 130.

The perforating gun system 112 may include a first detonation cord 402 connected to each charge 120 of the first group of charges 232 and a second detonation cord 404 connected to each charge 120 of the second group of charges 234. The distance along the first detonation cord 402 between adjacent charges 120 of the first group of charges 232 may be less than the distance along the second detonation cord 404 between adjacent charges 120 of the second group of charges 234 due to the radially offset positions of the charges 120 of the second group of charges 234. To adjust for the difference in lengths between adjacent charges 120, the first detonation cord 402 may comprise at least one lengthening feature 410 configured to increase a time delay between shaped charged detonations along the first detonation cord 402. Specifically, the at least one lengthening feature 410 may increase the length of the first detonation cord 402 such that the distance along the first detonation cord 402 between adjacent charges 120 of the first group of charges 232 is about the same as the distance along the second detonation cord 404 between adjacent charges 120 of the second group of charges 234, which may cause the first group of charges 232 and the second group of charges 234 to detonate at relatively the same time and reduce shock interference. The at least one lengthening feature 410 may comprise a suitable knot disposed along the length of the first detonation cord 402. Alternatively, the at least one lengthening feature 410 may include winding the first detonation cord 402 about the second detonation cord 404 or about the central support structure 130. Further, the first detonation cord may include at least one lengthening feature 410 disposed between each pair of adjacent charges 120 of the first group of charges 232.

Figure 6:
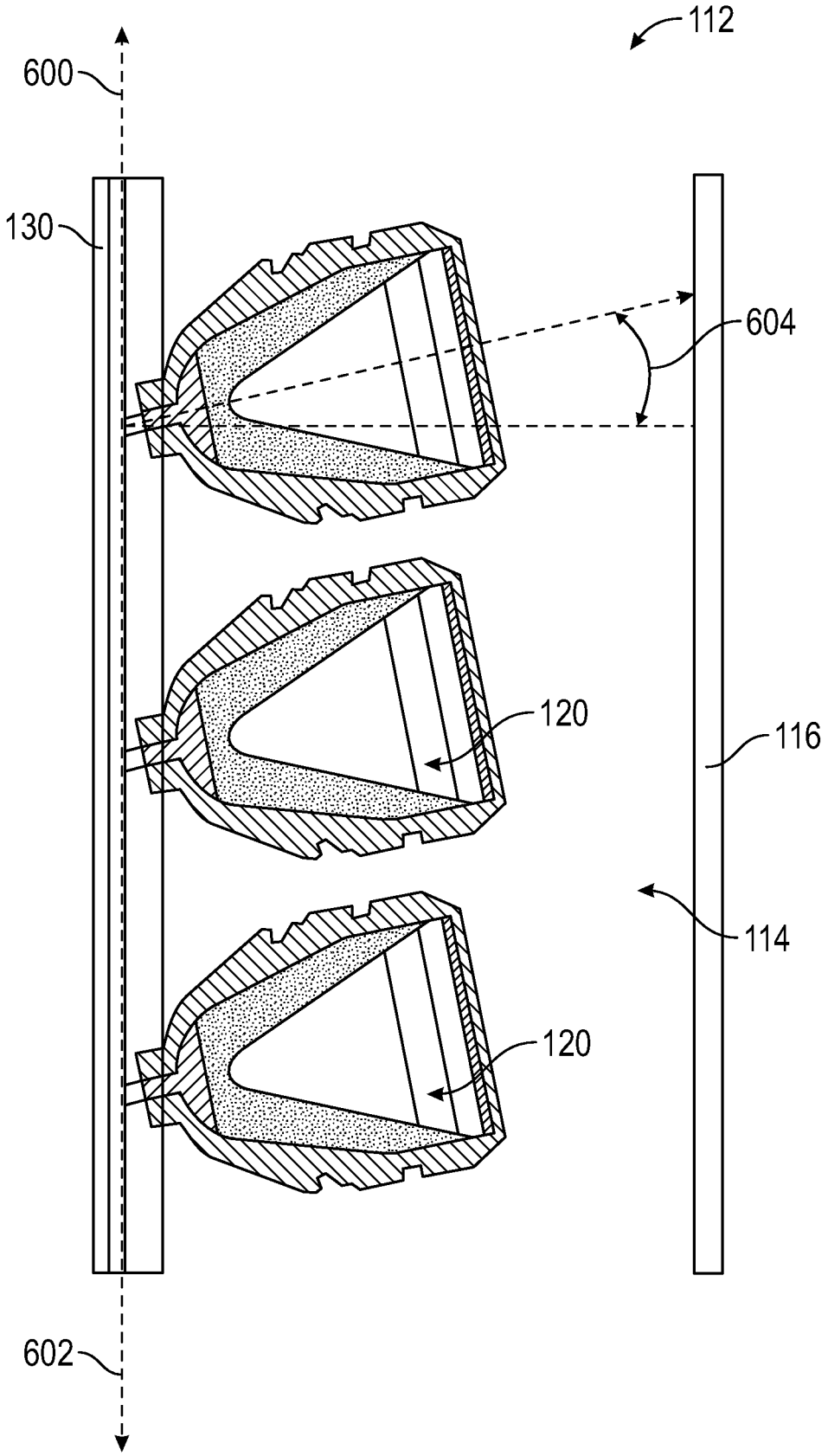
FIG. 6 illustrates a cross-sectional view of the perforating gun system having axially angled shaped charges, in accordance with some embodiments of the present disclosure.

FIG. 6 illustrates a cross-sectional view of the perforating gun system 112 having axially angled shaped charges, in accordance with some embodiments of the present disclosure. As set forth above, the perforations from each charge of the plurality of charges 120 contribute to the total flow area formed through the casing 116. Further, increasing the total flow area formed through the casing 116 may increase performance of various wellbore operations. As set forth below, axially angled shaped charges 120 may increase the size of the perforations formed from each charge 120.

In the illustrated embodiment, the perforating gun system 112 includes the plurality of charges 120 secured to the central support structure 130. The plurality of charges 120 may be secured directly to the central support structure 130. In some embodiments, the plurality of charges 120 may be secured to the central support structure 130 via a plurality of extension features 230 (shown in FIG. 2). Further, each charge 120 of the plurality of charges 120 (e.g., the first group of charges 232 and/or the second group of charges 234) may be secured to the central support structure 130 at an angle with respect to the central support structure 130 such that the charges 120 may form slanted perforations in the casing 116 upon detonation. The slanted perforations may be oval shaped as the charges 120 are detonated at a non-perpendicular angle with respect to the casing 116. These oval shaped perforations may have a greater area than a substantially circular shaped perforation formed from the same charge 120 instead being aimed normal (e.g., perpendicular) to the casing 116. Accordingly, the angled shaped charges 120 may increase the size of the perforations formed from each charge 120.

Moreover, the shaped charges 120 may be angled with respect to the central support structure 130 in an axial direction. That is, the shaped charges 120 may be angled in an uphole direction 600 and/or a downhole direction 602 with respect to the central support structure 130. In the illustrated embodiment, the shaped charges 120 are angled in the uphole direction 600 with respect to the central support structure 130. For example, the shaped charges 120 may be offset in the axially uphole direction 600 by an angle 604 of five to forty-five degrees. In the illustrated embodiment, the shaped charges 120 are offset in the axially uphole direction 600 by an angle 604 of about twenty degrees. The shaped charges 120 may be axially offset in the uphole direction 600 by any suitable angle 604. Further, in some embodiments, the axially angled shaped charges 120 may be angled in a downhole direction 602 with respect to the central support structure 130. Similarly, the shaped charges 120 may be offset in the axially downhole direction 602 by an angle of five to forty-five degrees. Angling the shaped charges 120 in the axially downhole direction 602 may provide the benefit of reducing the amount of sand entering into the wellbore 114 because the sand may have to overcome gravity to go into the wellbore 114. Further, in some embodiments, the perforating gun system 112 may include charges 120 angled in both the axially uphole direction 600 and in the axially downhole direction 602.

Figure 7:
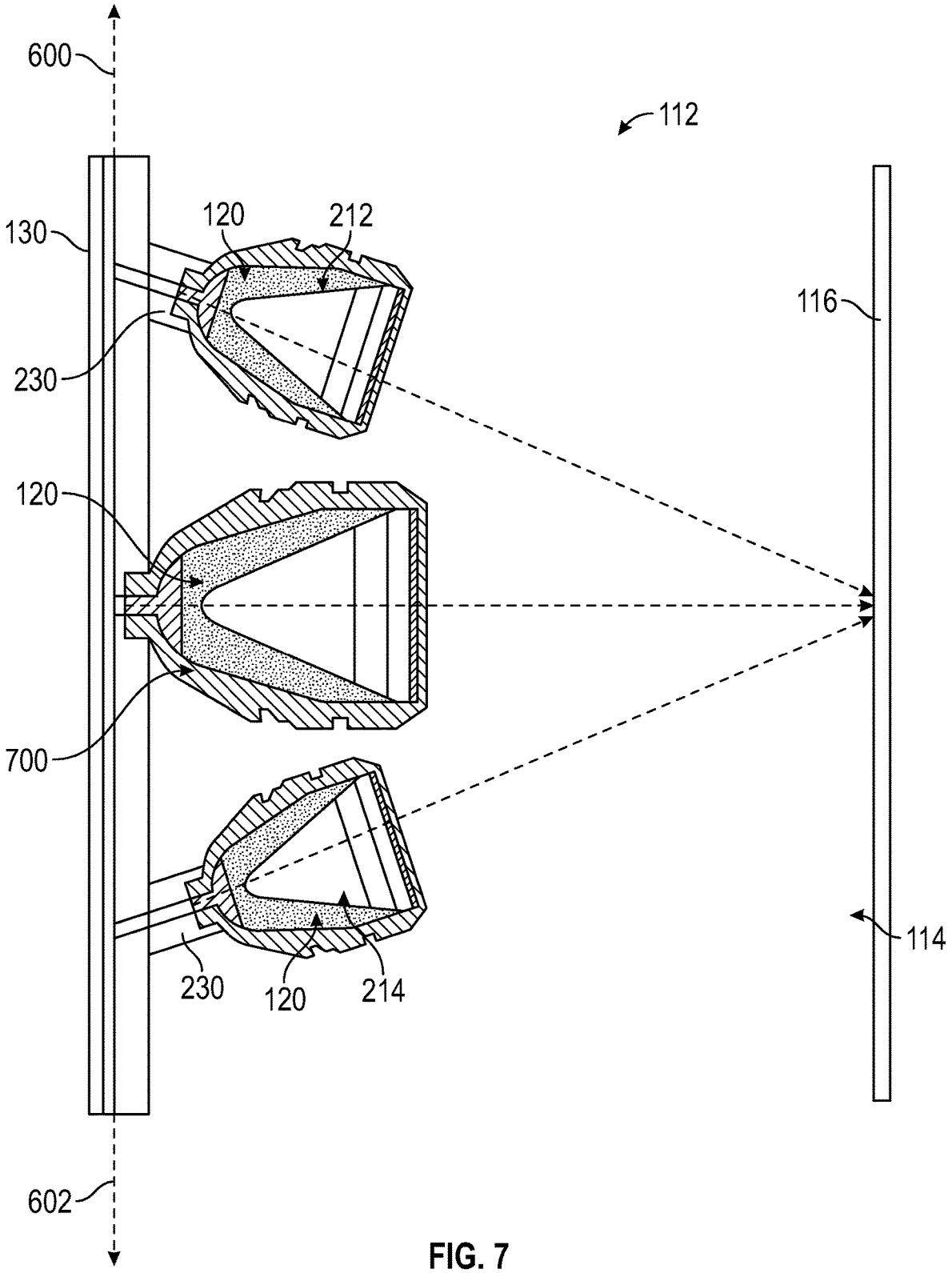
FIG. 7 illustrates a cross-sectional view of the perforating gun system having axially angled shaped charges directed toward a focal point, in accordance with some embodiments of the present disclosure.

FIG. 7 illustrates a cross-sectional view of the perforating gun system having axially angled shaped charges directed toward a focal point, in accordance with some embodiments of the present disclosure. As illustrated, the perforating gun system 112 includes the plurality of charges 120 secured to the central support structure 130. The plurality of charges 120 may be secured directly to the central support structure 130. In some embodiments, the plurality of charges 120 may be secured to the central support structure 130 via a plurality of extension features 230. Further, at least one charge of the plurality of charges 120 (e.g., the first group of charges 232 and/or the second group of charges 234) may be secured to the central support structure 130 at an angle with respect to the central support structure 130.

In the illustrated embodiment, the perforating gun system 112 includes a first charge 212 and a second charge 214 that are each angled with respect to the central support structure 130. In particular, the first charge 212 may be angled in the downhole direction 602 and the second charge may be angled in the axially uphole direction 600 such that the first charge 212 and the second charge 214 are aimed at a substantially same portion of the casing 116. As illustrated, the first charge 212 and second charge 214 may be aimed at a same portion of the casing 116 as another charge (e.g., a third charge 700) oriented normal to the casing 116. Having multiple charges 120 aimed at a same portion of the casing 116 (e.g., a same focal point) may form a larger perforation in the casing than a single charge. Additionally, having multiple charges 120 aimed at a same portion of the casing 116 (e.g., a same focal point) may increase penetration depth into the formation surrounding the wellbore 114.

Figure 8:
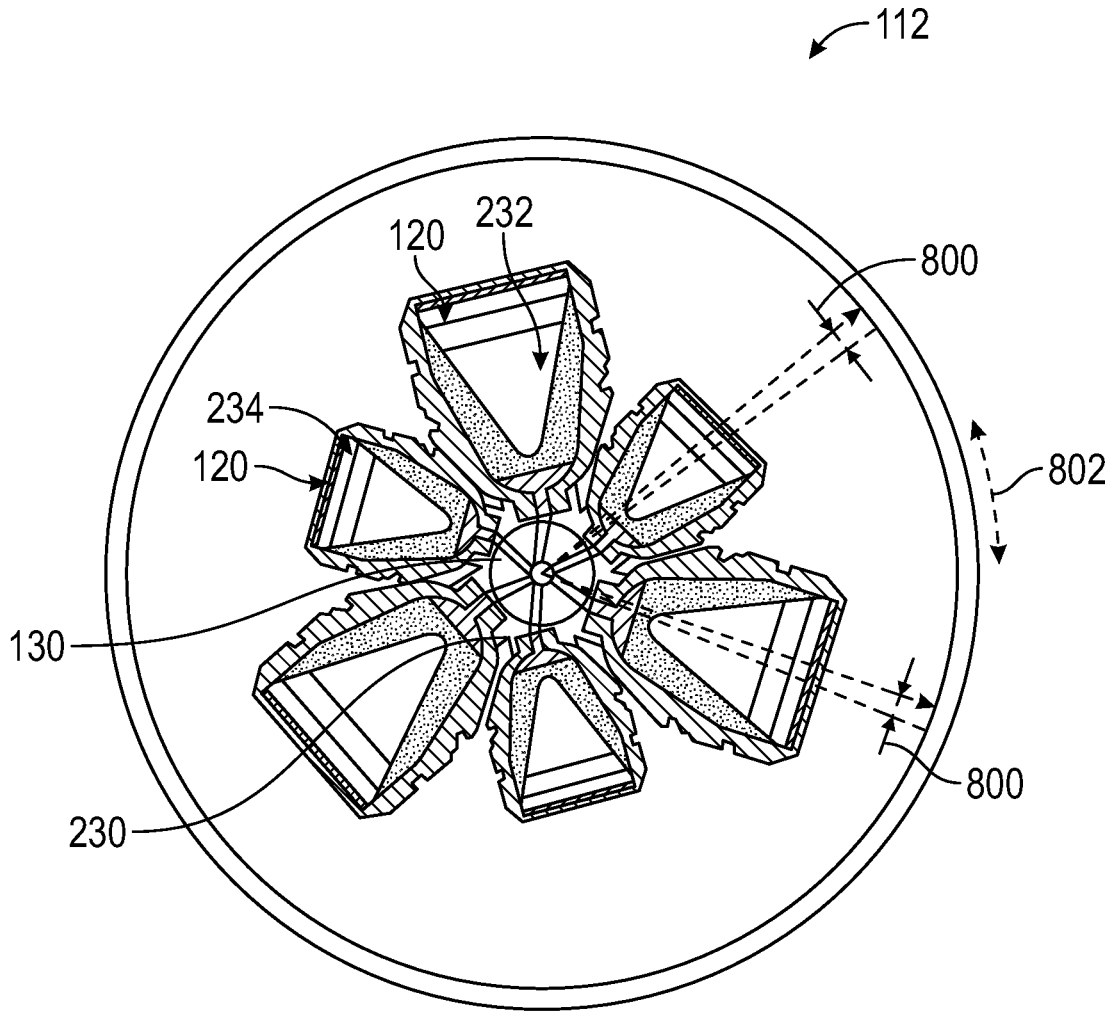
FIG. 8 illustrates a cross-sectional view of the perforating gun system having circumferentially angled shaped charges, in accordance with some embodiments of the present disclosure.

FIG. 8 illustrates a cross-sectional view of the perforating gun system having circumferentially angled shaped charges, in accordance with some embodiments of the present disclosure. As illustrated, the perforating gun system 112 includes the plurality of charges 120 secured to the central support structure 130. The plurality of charges 120 may be secured directly to the central support structure 130. In some embodiments, the plurality of charges 120 may be secured to the central support structure 130 via a plurality of extension features 230. Further, at least one charge of the plurality of charges 120 (e.g., the first group of charges 232 and/or the second group of charges 234) may be secured to the central support structure 130 at an angle 800 with respect to the central support structure 130.

In the illustrated embodiment, each charge of the plurality of charges 120 is secured to the central support structure 130 at an angle. In particular, the charges 120 are angled in a circumferential direction 802 (e.g., clockwise and/or counterclockwise) with respect to the central support structure 130. The shaped charges may be offset in the circumferential direction 802 by five to twenty degrees. In the illustrated embodiment, the shaped charges 120 are offset in the circumferential direction 802 by about ten degrees. However, the shaped charges 120 may be circumferential offset by any suitable amount.

Accordingly, the present disclosure may provide a perforating gun system configured to increase flow area through a casing and/or wellbore to increase performance of various wellbore operations by increasing shot density on the perforating gun system and/or shaped charge angles with respect to a central support structure of the perforating gun system. The system may include any of the various features disclosed herein, including one or more of the following statements.

Statement 1. A perforating gun system, comprising: a central support structure; a plurality of charges secured to the central support structure, wherein each charge of the plurality of charges is configured to perforate a casing and/or sidewall of a wellbore upon detonation, and wherein the plurality of charges comprises: a first group of charges; and a second group of charges, wherein each charge of the second group of charges is radially offset from each charge of the first group of charges with respect to the central support structure.

Statement 2. The perforating gun system of statement 1, wherein each charge of the second group of charges is larger than each charge of the first group of charges.

Statement 3. The perforating gun system of statement 1 or statement 2, wherein each charge of the second group of charges is positioned radially outward from each charge of the first group of charges with respect to the central support structure.

Statement 4. The perforating gun system any preceding statement, wherein each charge of the plurality of charges comprises: a charge casing having a coupling end and a distal end disposed radially outward from the coupling end with respect to the central support structure, wherein the distal end has a greater diameter than the coupling end, and wherein the distal end of each charge of the first group of charges and the second group is radially offset from the distal end of each charge of the second group of charges such that the charges of the first group of charges have greater stand-off distances than the charges of the second group of charges; a conical liner disposed at least partially within the charge casing; and explosive material disposed between the liner and the charge casing, wherein the explosive material is configured to expel the liner outward from the charge casing upon detonation to perforate a target material.

Statement 5. The perforating gun system any preceding statement, wherein at least a portion of each shaped charge of the first group of shaped charges overlaps with an adjacent shaped charge in an axial direction.

Statement 6. The perforating gun system any preceding statement, wherein at least a portion of each shaped charge of the first group of shaped charges overlaps with an adjacent shaped charge in a radial direction to reduce spacing between adjacent charges.

Statement 7. The perforating gun system any preceding statement, further comprising a first detonation cord connected to each charge of the first group of charges and a second detonation cord connected to each charge of the second group of charges.

Statement 8. The perforating gun system any preceding statement, further comprising a detonation cord connected to each charge of the first group of charges and a plurality of detonation branches, wherein each branch of the plurality of detonation branches is connected at a first end to the detonation cord and connected at a second end to a corresponding charge of the second group of charges.

Statement 9. The perforating gun system any preceding statement, wherein the central support structure comprises a hollow tubing having a central bore defined by an inner surface of the hollow tubing, and wherein the central bore is configured to house one or more detonation cords.

Statement 10. The perforating gun system any preceding statement, further comprising at least one extension feature attachable to an outer surface of the central support structure, wherein the at least one extension feature is configured to couple a corresponding charge of the second group of shaped charges to the central support structure.

Statement 11. The perforating gun system any preceding statement, wherein the first group of shaped charges are configured to couple directly to the central support structure.

Statement 12. The perforating gun system any preceding statement, further comprising; a gun body; and a charge tube disposed within the gun body, wherein the central support structure and the plurality of charges are disposed within the charge tube.

Statement 13. A perforating gun system, comprising: a central support structure; a plurality of charges secured to the central support structure, wherein each charge of the plurality of charges is configured to perforate a casing and/or sidewall of a wellbore upon detonation, and wherein the plurality of charges comprises a first group of charges and a second group of charges; a first detonation cord connected to each charge of the first group of charges; and a second detonation cord connected to each charge of the second group of charges.

Statement 14. The perforating gun system of statement 13, wherein each charge of the second group of charges is positioned radially outward from each charge of the first group of charges with respect to the central support structure.

Statement 15. The perforating gun system of statement 14, wherein the first detonation cord and the second detonation cord each comprise an outer sleeve and an explosive powder disposed in the outer sleeve, wherein a second density of a second explosive powder of the second detonation cord is greater than a first density of a first explosive powder of the first detonation cord.

Statement 16. The perforating gun system of any of statements 13-15, wherein the first detonation cord is connected to the first group of charges in series and the second detonation cord is connected to the second group of charges in parallel.

Statement 17. The perforating gun system of any of statements 13-16, wherein the first detonation cord comprises at least one lengthening feature configured to increase a time delay between shaped charged detonations along the first detonation cord.

Statement 18. A perforating gun system, comprising: a central support structure; a plurality of charges secured to the central support structure, wherein each charge of the plurality of charges is configured to perforate a casing and/or sidewall of a wellbore upon detonation, and wherein the plurality of charges comprises: a first group of charges; and a second group of charges, wherein each charge of the second group of charges is angled with respect to the central support structure to form slanted perforations in the casing and/or the sidewall of the wellbore upon detonation.

Statement 19. The perforating gun system of statement 18, wherein each charge of the second group of charges is disposed radially outward from each charge of the first group of charges with respect to the central support structure.

Statement 20. The perforating gun system of statement 18 or statement 19, wherein each charge of the first group of charges is angled with respect to the central support structure to form slanted perforations in the casing and/or the sidewall of the wellbore upon detonation.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

What is claimed is:

1. A perforating gun system, comprising:

a central support structure;

a plurality of charges secured to the central support structure, wherein each charge of the plurality of charges is configured to perforate a casing and/or sidewall of a wellbore upon detonation, and wherein the plurality of charges comprises:

a first group of charges; and a second group of charges, wherein each charge of the second group of charges is radially offset from each charge of the first group of charges with respect to the central support structure, wherein each charge of the second group of charges is positioned radially outward from each charge of the first group of charges with respect to the central support structure.

2. The perforating gun system of claim 1, wherein each charge of the second group of charges is larger than each charge of the first group of charges.

3. The perforating gun system of claim 1, wherein each charge of the plurality of charges comprises:

a charge casing having a coupling end and a distal end disposed radially outward from the coupling end with respect to the central support structure, wherein the distal end has a greater diameter than the coupling end, and wherein the distal end of each charge of the first group of charges and the second group is radially offset from the distal end of each charge of the second group of charges such that the charges of the first group of charges have greater stand-off distances than the charges of the second group of charges;

a conical liner disposed at least partially within the charge casing; and explosive material disposed between the liner and the charge casing, wherein the explosive material is configured to expel the liner outward from the charge casing upon detonation to perforate a target material.

4. The perforating gun system of claim 1, wherein at least a portion of each shaped charge of the first group of shaped charges overlaps with an adjacent shaped charge in an axial direction.

5. The perforating gun system of claim 1, wherein at least a portion of each shaped charge of the first group of shaped charges overlaps with an adjacent shaped charge in a radial direction to reduce spacing between adjacent charges.

6. The perforating gun system of claim 1, further comprising a first detonation cord connected to each charge of the first group of charges and a second detonation cord connected to each charge of the second group of charges.

7. The perforating gun system of claim 1, further comprising a detonation cord connected to each charge of the first group of charges via a plurality of detonation branches, wherein each branch of the plurality of detonation branches is connected at a first end to the detonation cord and connected at a second end to a corresponding charge of the first group of charges.

8. The perforating gun system of claim 1, wherein the central support structure comprises a hollow tubing having a central bore defined by an inner surface of the hollow tubing, and wherein the central bore is configured to house one or more detonation cords.

9. The perforating gun system of claim 1, further comprising at least one extension feature attachable to an outer surface of the central support structure, wherein the at least one extension feature is configured to couple a corresponding charge of the second group of shaped charges to the central support structure.

10. The perforating gun system of claim 1, wherein the first group of shaped charges are configured to couple directly to the central support structure.

11. The perforating gun system of claim 1, further comprising;

a gun body; and a charge tube disposed within the gun body, wherein the central support structure and the plurality of charges are disposed within the charge tube.

12. The perforating gun system of claim 1, wherein a first distal end of at least one charge of the first group of charges is offset from the central support structure by a first distance, wherein a second distal end of at least one charge of the second group of charges is offset from the central support structure by a second distance, and wherein the first-second distance is greater than the first distance.

* * * * *